United States Patent [19]

Hofmann

[11] 4,351,077

[45] Sep. 28, 1982

[54] CLEANING APPARATUS FOR SUBMERGED SURFACES

[76] Inventor: Helmut J. Hofmann, 79 Juta St., Braamfontein, Johannesburg, Transvaal Province, South Africa

[21] Appl. No.: 217,604

[22] Filed: Dec. 18, 1980

[30] Foreign Application Priority Data

Dec. 18, 1979 [ZA] South Africa ..... 79/6583

[51] Int. Cl.[3] ..... E04H 3/20

[52] U.S. Cl. ..... 15/1.7

[58] Field of Search ..... 15/1.7, 420, 421, 404

[56] References Cited

U.S. PATENT DOCUMENTS 4,023,227 5/1977 Chauvier ..... 15/1.7

4,133,068 1/1979 Hofmann ..... 15/1.7

*Primary Examiner*—Edward L. Roberts

*Attorney, Agent, or Firm*—Sughrue, Mion, Zinn, Macpeak and Seas

[57] ABSTRACT

Cleaning apparatus of the type including a cleaning head for cleaning submerged surfaces and a flapper valve for moving the head relative to the surface by oscillation thereof. An annular flexible disc located at the inlet end of the suction head surrounds a central opening below the flexible disc and at least one transverse inlet opening to the passage through the suction head is located above and adjacent the flexible disc. The transverse inlet opening is substantially symmetrical about the direction of movement of the head and faces in the general direction towards which the head moves in operation. An upper member held in spaced relation relative to the disc may be provided to define a flow path between it and the disc towards the transverse inlet opening.

5 Claims, 4 Drawing Figures

CLEANING APPARATUS FOR SUBMERGED SURFACES

This invention relates to apparatus for automatically cleaning the submerged surfaces of swimming pools and the like.

In South African Pat. No. 77/6199 there is described automatic swimming pool cleaning apparatus which relies for its operation on the intermittent cutting off of flow through a cleaning head in contact with the surface of the swimming pool to be cleaned. The means for cutting off the flow is a flapper valve of substantially triangular cross-section and which pivots about the apex of the triangle to open and close a free flow passage through the head and alternately open and close a second very restricted passage through the head. The cleaning head is held in proximity to the surface to be cleaned by a perforated flexible annular disc surrounding the head. The inlet openings into the head include a central opening below the flexible disc and two side openings above the disc. These side openings are diametrically opposed and are directed transverse to the direction of movement of the head. To improve the flow of water and dirt into the openings they are each provided with a guide extending outwardly above and across the surface of the disc. Although a large part of the dirt moving across the upper surface of the disc is collected in this manner it is believed that the efficiency of this collection could be improved.

Another apparatus of the same general type also has a cleaning head incorporating a flapper valve. However, it also includes two suction passages which communicate with the head and flapper valve so that the flapper valve alternately and repeatedly transfers liquid flow from the head through the two passages.

An object of this invention is to provide apparatus, of the type including a cleaning head and flapper valve, for cleaning submerged surfaces in which the efficiency of the collection of the dirt on a submerged surface may be improved.

According to the invention cleaning apparatus of the type including a cleaning head and flapper valve for cleaning submerged surfaces comprises an annular flexible disc located at the inlet end of a suction head, the suction head including a flapper valve between the inlet and outlet therefor and the inlet comprising a central opening below the flexible disc and at least one transverse opening located above and adjacent the flexible disc so as to be substantially symmetrical about the direction of movement thereof and to face in the general direction towards which the head moves in operation.

Further according to the invention the inlet located above the disc is located between the disc and an upper, preferably flexible, member extending above at least the operatively forward part of the disc and spaced along its periphery therefrom by a plurality of spaced substantially radial ribs.

Still further according to the invention the periphery of the upper flexible member may, in plan view, be substantially co-incident with the periphery of the disc and the ribs are integral with the upper flexible member.

Yet further according to the invention the inlet opening located above the disc comprises two similar inlet ports arranged symmetrically about the direction of movement of the apparatus and the axes of the ports radiate from the central opening at an angle of about 45° to the direction of movement of the apparatus.

An embodiment of the invention described by way of example only follows with reference to the accompanying drawings in which.

In this embodiment of the invention apparatus for cleaning the submerged surfaces of swimming or other pools comprises a suction head 1 which is of basically rectangular cross-section and having inlet openings at one end and a circular outlet 2 at the other end. Located between the inlet openings and the outlet is an oscillatible flapper valve 3 of known type.

Figure 1:
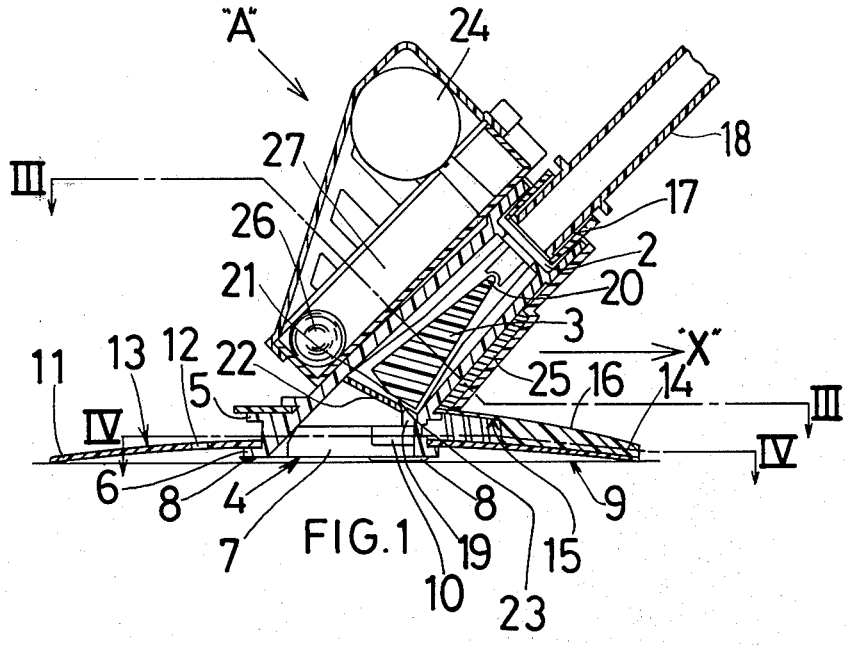
FIG. 1 is a sectional elevation of an apparatus for cleaning submerged surfaces.
Figure 2:
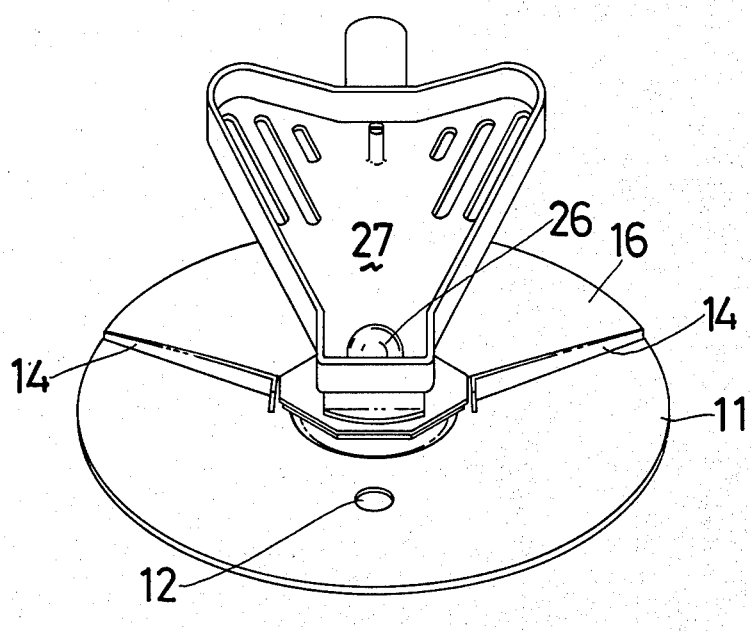
FIG. 2 is a front elevation (partly sectioned) taken in the direction of arrow "A" in FIG. 1.
Figure 3:
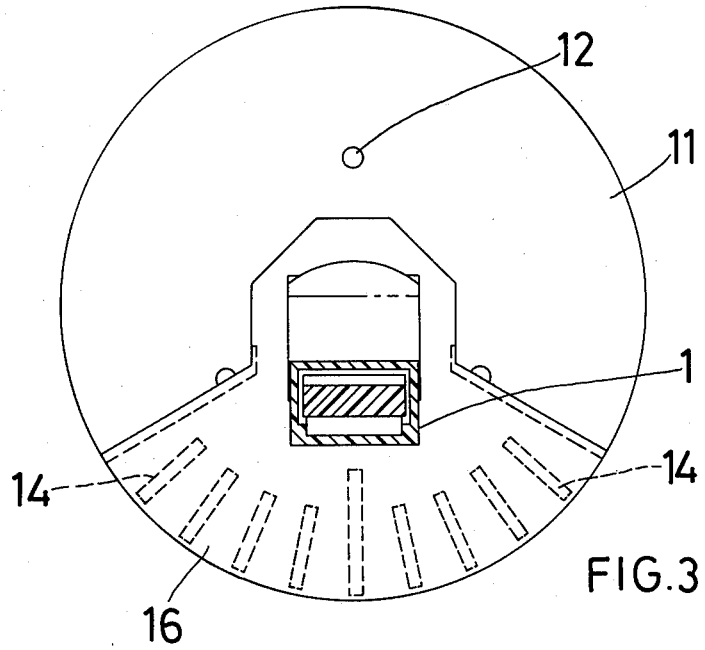
FIG. 3 is a partly sectioned plan view taken along line III—III in FIG. 1; and, FIG. 4 is a second partly sectioned plan view but taken along line IV—IV in FIG. 1.

The end 4 of the head 1 associated with the inlet openings is a short substantially cylindrical portion of circular cross-section, the axis of which is at about 45° to the axis of the main body of the head and the outlet opening. This cylindrical portion is bounded by upper and lower outwardly extending flanges indicated by numerals 5 and 6 respectively in FIG. 1.

The bottom end of the cylindrical portion 4 defines a central opening 7 with suitably spaced feet 8 around the periphery thereof to provide space between the inlet 7 and the surface 9 on which the head is located through which water may flow. Between the two flanges 5 and 6 are two substantially rectangular inlet ports 10. These ports have their axes radiating from the axis of the central opening 7 and at an angle of about 45° to the direction in which the apparatus is designed to move. This direction is indicated by arrow "X" and, as will be seen below, the axis of the main body of the head 1 lies in this direction in plan view.

An annular disc 11 of flexible plastics material is located on the lower flange 6. The disc has apertures 12 therethrough (only one shown for simplicity) which allow water to pass from the upper surface 13 of the disc to the central opening 7 when a suction is applied to the outlet 2 of the head. This limits the force with which the disc and head are held against the surface being cleaned.

Supported on the upper surface of the disc and in the operatively forward region thereof are a plurality of spaced short radial ribs 14 formed integral with an upper flexible member. The ribs serve to space the upper surface of the disc from the lower surface 15 of the upper flexible member 16 supported by the body on the upper flange 5. As may be seen from the drawings the periphery of this flexible member 16 follows that of the disc 11 in plan view and the flexible member is of roughly sector-shape having an included angle of about 120°.

The ribs may alternatively be made integral with the disc if this is preferred.

Simply to complete the description of an operative device the following is included in this specification.

The outlet 2 has a swivelable fitting 17 incorporated therein so that the head can be attached to a longitudinally extending suction pipe 18 carried at one end of an elongate flexible suction pipe (not shown) for attachment to a pump.

The oscillatable valve 3 is located within the head between the inlet and outlet so that it may open or close a passage 19 through the head between the inlet and outlet. The valve is of substantially triangular cross-section so that it may oscillate about its apex 20 adjacent the outlet. The base of the valve is slightly peaked as indicated at 21 so that it may move over and co-operate with a partition member 22 located in the inlet end of the head 1 when water is caused to flow through into the head.

On the side of the valve opposite the flow passage 19 through the head is a suction communication which is designed so that there is as restricted an opening between inlet and outlet of the head as is commensurate with the proper operation of valve 3. Water flow through the suction communication is therefor greatly reduced compared to that through the passage 19. The suction communication is adapted to be shut off when the flow passage is open and is only open for a brief period when the valve 3 closes the flow passage. The shape and size of the valve 3 in the head together with the location of the partition member 22 constricts the suction communication to the size which prevents appreciable liquid flow therethrough.

Internal formations are provided in the head to constrain the movement of the valve 3 in the head and form valve seats to close off the flow passage 19 through the head and suction communication past the lower end of the valve.

The shape of the base of the valve providing the peak enables the space 23 between the valve and partition member 22 to remain substantially constant as the valve moves between its terminal positions and is also symmetrical.

With the construction above set forth it has been found that when the head is submerged and a swimming pool and filter suction applied to the outlet the flow of water causes the valve to oscillate between its two terminal positions. In one such position the flow is substantially full and direct through the opening 19 to the outlet 2 while in the other there is maximum reduction in liquid flow through the head. This results, in use, to an intermittent cut-off flow through the head as the valve oscillates between its terminal positions and this in turn causes pulsations which result in longitudinal contractions and relaxations in the longitudinally resilient suction pipe from the head to the outlet from the swimming pool to its filter unit.

In consequence of these contractions and relaxations and a simultaneous reduction and increase of the force applied to hold the disc 11 against the surface to be cleaned a step by step movement of the head takes place over the surface to be cleaned.

The movement is automatic but random and to control this a buoyancy chamber 24 is provided. This will preferably be provided with a hollow float. This chamber ensures that while the head will sink with the aid of any necessary weights 25 onto the surface to be cleaned it will, nevertheless, be correctly orientated thereto.

Also because the apparatus can operate on vertical walls it is necessary to provide suitable counterbalancing to prevent the head from climbing above the water level and allow air to be drawn through the system. This can be easily effected in known manner by having a freely movable spherical weight 26 in a Vee-shaped guide 27 attached to the head across the width thereof. It may be fitted to either the upper or lower surface of the head.

Figure 4:
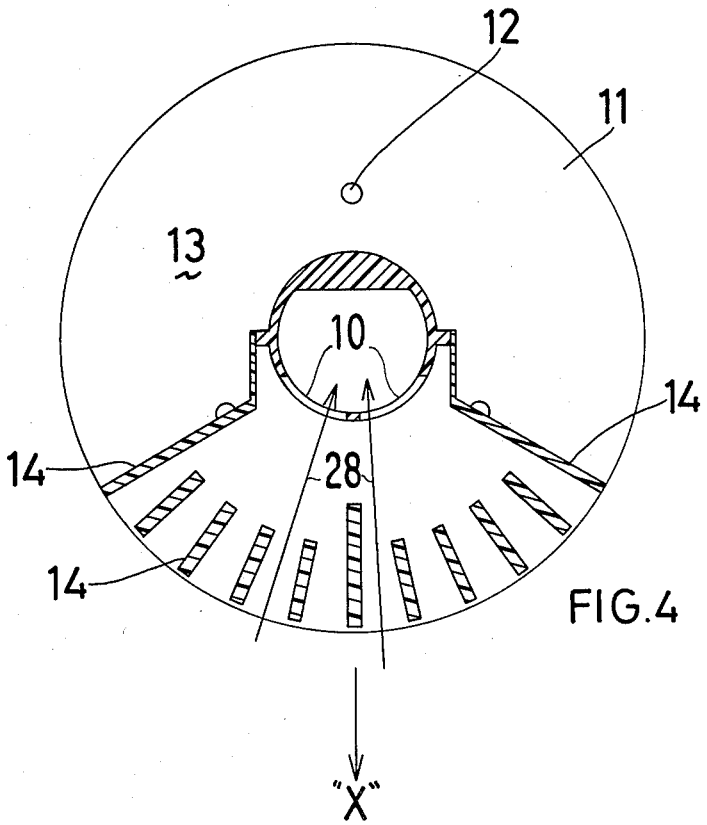

Reverting now to the invention itself it will be understood that when the apparatus moves in a forward direction as indicated by arrow "X" over the surface being cleaned, a significant amount of the dirt moves over the upper surface 13 of the disc 11. Because the ports 10 are directed forwardly this dirt is more easily sucked into the head. Furthermore, the upper flexible member 16 serves as a guide to guide the dirt and liquid towards the ports thus decreasing the amount of dirt which is simply stirred up by the machine and allowed to resettle. The spacing ribs 14 prevent the upper member from being sucked into complete contact with the disc thereby preserving the spaced relationship of the upper flexible member and disc. The ribs also direct the liquid and dirt towards the ports as shown by the arrows 28 in FIG. 4, and the two outermost ribs define outer boundary walls to the effective inlet duct defined between the disc and upper flexible members.

Other embodiments are envisaged within the scope of the invention including its application to other cleaning apparatuses of the same general type. It should be noted that the invention may be used without the upper flexible member which is simply an accessory which provides for greater cleaning efficiency.

It also appears that having the openings in the forward part of the head facilitates its movement over the surface to be cleaned.

What I claim as new and desire to secure by Letters Patent is:

1. An apparatus for cleaning submerged surfaces, such as the bottoms and walls of swimming pools, comprising:

(a) a suction head (1) having an inlet and an outlet (2), (b) an oscillatory flapper valve (3) disposed within the suction head between the inlet and outlet, (c) an annular flexible disc (11) mounted proximate the inlet of the suction head, (d) the inlet being defined by a central opening (7) disposed below the disc and at least one transverse opening (10) disposed above and adjacent the disc, the transverse opening being substantially symmetrical about a direction of movement (X) of the suction head and facing in the general direction of such movement, (e) a substantially sector-shaped upper member (16) disposed above the transverse opening and extending over a substantial portion of the disc, and (f) means (14) supporting the upper member in a spaced relationship relative to the disc, whereby liquid and dirt dislodged by the apparatus is guided and funnelled by and between the disc and upper member towards the transverse opening.

2. Cleaning apparatus as claimed in claim 1, wherein the supporting means comprises a plurality of substantially radially extending ribs disposed between the disc and the upper member.

3. Cleaning apparatus as claimed in claim 1 in which the upper member is flexible.

4. Cleaning apparatus as claimed in claim 1 in which the upper member is, in plan view, substantially co-incident at an outer periphery thereof with the disc.

5. Cleaning apparatus as claimed in claim 1, in which there are two transverse inlet openings arranged symmetrically about the direction of movement of the suction head and wherein axes of these inlets radiate at about 45° to such direction of movement.

* * * * *